US005266019A

United States Patent [19]

Farber

[11] Patent Number: 5,266,019

[45] Date of Patent: Nov. 30, 1993

[54] APPARATUS AND METHOD FOR APPLYING A FLOWABLE MATERIAL TO A SURFACE FOR FORMING MOLDING THEREON

[76] Inventor: Claude W. Farber, Rte. 1, Box 970, Wartz, Va. 24184

[21] Appl. No.: 607,274

[22] Filed: Oct. 31, 1990

[51] Int. Cl.[5] ..... B05C 9/08

[52] U.S. Cl. ..... 425/113; 118/207; 425/131.1; 425/462

[58] Field of Search ..... 118/207, 411; 425/113, 425/131.1, 133.5, 87, 462; 427/277, 284, 286

[56] References Cited

U.S. PATENT DOCUMENTS

| | | | |
|---|---|---|---|
| 1,382,397 | 6/1921 | Whitehouse | 401/176 |
| 2,300,398 | 11/1942 | Ames | 425/87 |
| 2,454,821 | 11/1948 | McKee | 427/286 |
| 2,889,699 | 6/1959 | Ames | 425/87 |
| 2,903,739 | 9/1959 | Hann | 425/87 |
| 2,982,992 | 5/1961 | Brown et al. | 425/87 |
| 3,089,180 | 5/1963 | Humphrey | 401/9 |
| 3,278,960 | 10/1966 | Nardone | 427/286 |
| 3,786,966 | 1/1974 | Behunin et al. | 222/387 |
| 4,476,165 | 10/1984 | McIntyre | 118/411 X |
| 4,521,457 | 6/1985 | Russell et al. | 427/286 |
| 4,844,004 | 7/1989 | Hadzimihalis et al. | 427/286 |
| 5,085,891 | 2/1992 | Evans | 427/277 |
| 5,090,354 | 2/1992 | Fereretti | 427/286 |

*Primary Examiner*—Shrive Beck
*Assistant Examiner*—Diana Dudash
*Attorney, Agent, or Firm*—Shlesinger Arkwright & Garvey

[57] ABSTRACT

The present invention is directed to a method and apparatus for applying a flowable material to a surface for forming molding thereon. An embodiment of the present invention includes a body member having top, bottom, front and rear surfaces. An inlet is operably associated with the body member for receiving flowable material from a supply source. An outlet is operably associated with the body member to dispense the flowable material through the body member. At least one passageway extends between the inlet and the outlet. A molding head formed in the body member shapes the flowable material to form at least one strip of molding on the surface.

21 Claims, 7 Drawing Sheets

APPARATUS AND METHOD FOR APPLYING A FLOWABLE MATERIAL TO A SURFACE FOR FORMING MOLDING THEREON

FIELD OF THE INVENTION

The preferred embodiment of the present invention generally relates to a method and apparatus for forming molding on a surface.

BACKGROUND OF THE INVENTION

Decorative moldings of various shapes, sizes, and styles have been widely used in residential homes, commercial buildings, and in many consumer products to enhance the aesthetic appearance of the same. It has previously been known to form moldings from such materials as wood, plastic, and metal.

Conventional methods for installing molding are laborious, time consuming, and expensive. Furthermore, conventional methods have required the skill of a craftsman to properly install the molding. Previously known methods of installation include the following steps. First, the material is machined to a desired configuration. Subsequently, the material is cut to the precise length needed. The ends of adjoining sections which form, for example, the inside corners of a room, the outside corners of a room, doorway corners and window corners are mitered. Once all cutting and mitering steps have been performed, the molding is secured to the surface by finishing nails and the like. A filling material, for example wood putty, is used to fill the holes formed in the molding by the finishing nails.

There are numerous drawbacks to installing molding in the aforementioned manner. Specifically, the machining step is expensive and requires special machinery to perform the same. Additionally, the material is usually machined at a location remote from the location where the molding is installed. Thus, the molding must be transported, sometimes over considerable distances, which further increases the cost and the likelihood of the molding becoming damaged. The cutting and mitering steps are very time consuming and thus significantly increase the time expended in installing the molding. Moreover, any imprecisions in either the cutting or mitering steps will lead to one of wasted material, the need for additional cutting or mitering, and unsightly imperfections in the installed molding. The step of securing the molding to the surface by finishing nails or similar fasteners generally requires two or more laborers. Also, the additional step of filling must be performed when using finishing nails or similar fasteners.

OBJECTS AND SUMMARY OF THE INVENTION

An object of the present invention is to provide an apparatus and method for installing molding which overcomes the disadvantages associated with the prior art.

Another object of the present invention is to provide a tool for installing molding which eliminates the need for machining the material used to form the molding.

A further object of the present invention is to provide a tool for shaping, sizing, and securing a flowable material to a surface for forming molding thereon.

Yet a further object of the present invention is to provide a tool for joining ends of adjacent strips of molding to form inside room corners, outside room corners, doorway corners, and window corners without mitering the same by conventional methods.

Still yet a further object of the present invention is to provide a tool that can form molding on elevated sections of a surface without the use of a ladder or similar support structures.

Another object of the present invention is to provide a tool with a plurality of independently moveable sections thereby permitting the tool to readily traverse objects on and around the surface such as door hinges and the like.

Yet another object of the present invention is to provide a tool with means for providing a flowable material with a woodtype finish.

Still a further object of the present invention is to provide a tool with a control valve and an actuating device, the actuating device being disposed adjacent the handle of the tool thereby permitting an individual to engage the actuating device with the same hand gripping the handle.

Yet a further object of the present invention is to provide a method for installing molding which obviates the need for saws, nails, nail sets, hammers, wood files, filling material, sandpaper and conventional mitering equipment.

Another object of the present invention is to provide a method for installing molding which shapes and sizes a flowable material to a desired configuration and length while the material is applied to a surface.

Still another object of the present invention is to provide a tool for installing molding which can be easily and readily operated with the use of a single hand.

A further object of the present invention is to provide a tool for installing molding on a surface which can be readily operated by the unskilled as well as skilled laborer.

Still yet another object of the present invention is to provide a tool for receiving flowable material, forming and securing the flowable material to a wall surface thereby forming molding thereon with a finished surface.

The aforementioned objects and advantages of the present invention, as well as others, will be readily apparent from a review of the detailed description of the invention.

In summary, the present invention is directed to an apparatus and method for applying a flowable material to a surface for forming strips of molding thereon.

DETAILED DESCRIPTION OF THE INVENTION

The preferred embodiment of the present invention will hereinafter be described.

Figure 1:
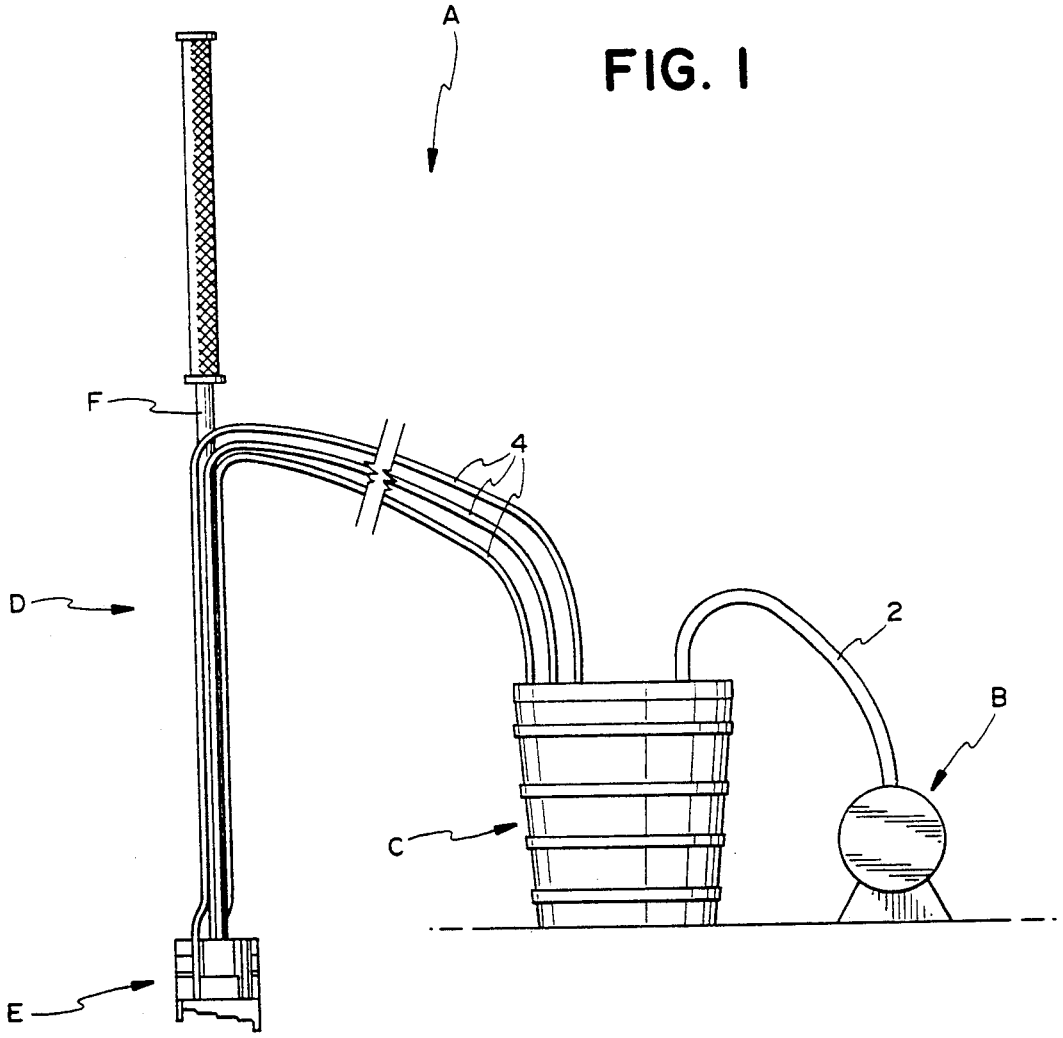
FIG. 1 is a front elevational view of a molding installation system formed in accordance with the preferred embodiment of the present invention.

Referring to FIG. 1, a molding installation system A includes a pneumatic pressure source B, a storage tub C, and a molding tool D. The molding tool D includes a molding head E and an extension arm F. The pneumatic pressure source B supplies air, under a desired pressure, to the storage tub C by way of pressure line 2. The pneumatic pressure source B is of conventional design. It will be readily appreciated that hydraulic pressure sources and the like could be used. The storage tub C stores a flowable material which possess adhesive and hardening characteristics. In the preferred embodiment, a spackling compound distributed by Red Devil under the trademark ONE TIME is used. However, it will be readily appreciated that other materials such as mastics may be used. The pressurized air passing through line 2 forces the material from the tub C through supply lines 4 to the molding head E. Each of the supply lines 4 may be inserted in a different storage tub C having a unique composition stored therein. In this manner, features such as the finish or color of the molding may be varied.

Figure 2:
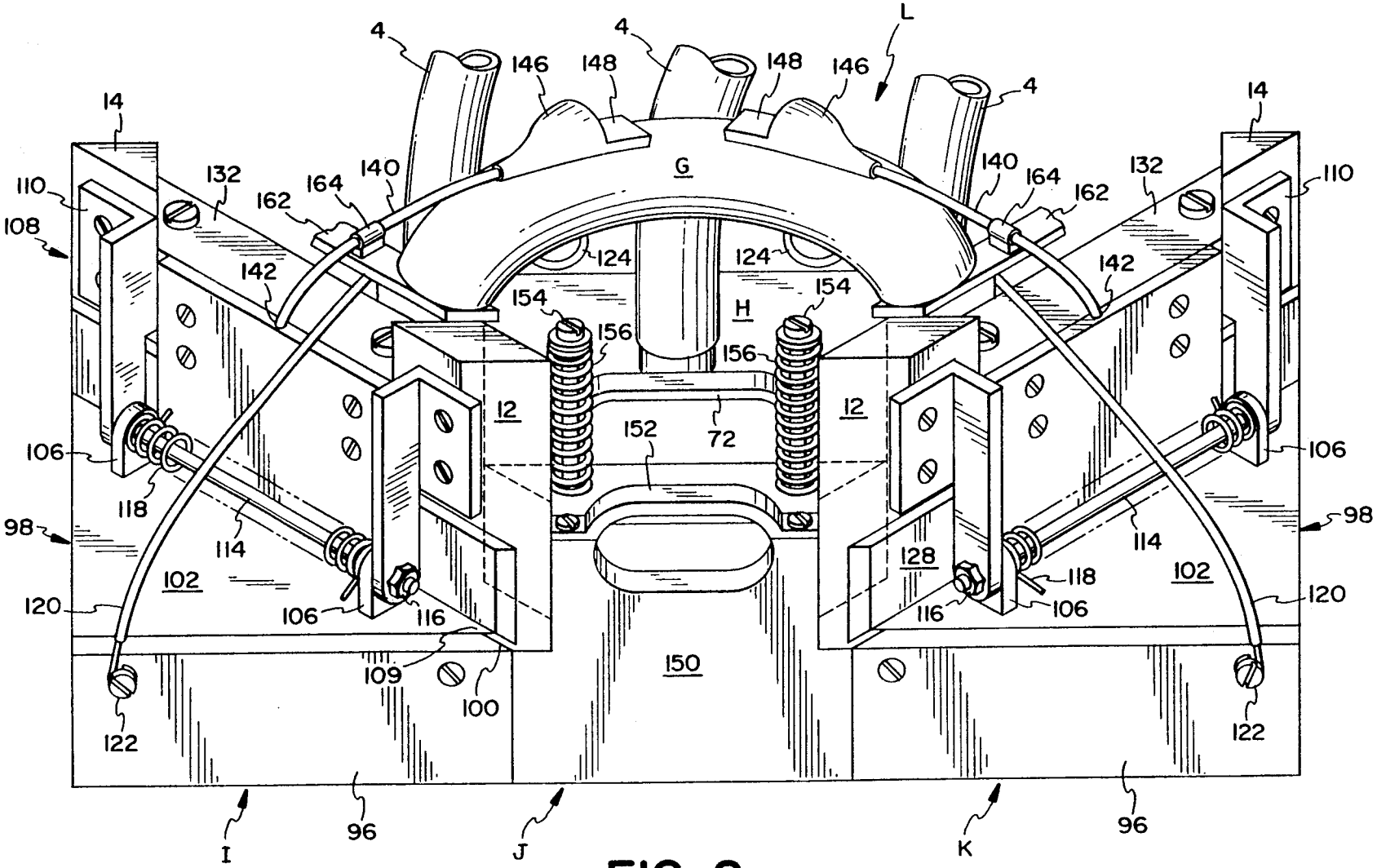
FIG. 2 is a perspective view of a molding head formed in accordance with the preferred embodiment of the present invention.

Referring to FIG. 2, the molding head E will hereinafter be explained in detail. Molding head E includes a handle G (substituted for extension arm F in FIG. 1), a central body member H, and independently moveable sections I, J, and K. It will be readily appreciated that either handle G and/or extension arm F may be detachably connected to the molding head E such that the same may be removed when not in use.

Figure 3:
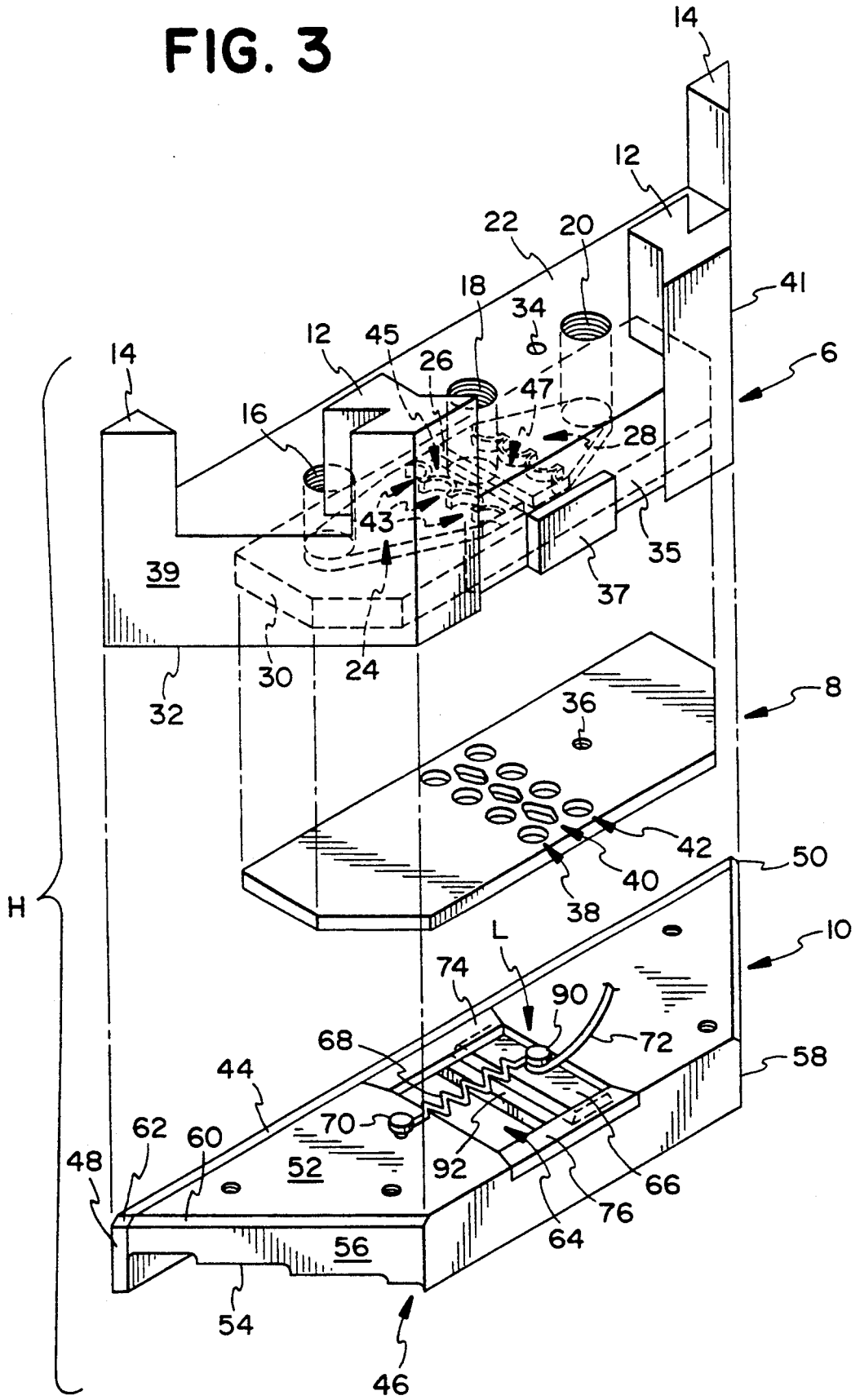
FIG. 3 is an exploded perspective view of the central portion of a molding head formed in accordance with the preferred embodiment of the present invention.

As seen in FIG. 3, central body member H includes a substantially trapezoidal shaped top plate 6, a cover plate 8, and a molding plate 10. The top plate 6 includes a pair of front columns 12 and a pair of rear columns 14. Three spaced orifices 16, 18 and 20 are formed in the upper surface of the top plate 6. The orifices 16, 18 and 20 are internally threaded. The left orifice 16 is substantially cylindrical in shape and extends from an upper surface 22 of top plate 6 to, and communicates with, substantially V-shaped passageway 24. Central orifice 18, similarly, is substantially cylindrical in shape and extends from the upper surface 22 of top plate 6 to, and communicates with, passageway 26. Right end orifice 20 is also cylindrical in shape and extends from the upper surface 22 of top plate 6 to, and communicates with, substantially V-shaped passageway 28. The top plate 6 has a recess 30 formed in a lower surface 32 thereof for receiving cover plate 8. An opening 34 extends from the upper surface 22 of top plate 6 through the lower surface 32. Front surface 35 of top plate 6 is recessed from the front columns 12 forming a step 37. The top plate 6 further includes left and right surfaces 39 and 41.

An opening 36 is formed in cover plate 8 and cooperates with opening 34 extending through top plate 6. First, second, and third rows of openings 38, 40, and 42, respectively, are formed in substantially the center of the cover plate 8. The first and third rows 38 and 42 each include four circular openings extending through top plate 8. The openings in first and third rows 38 and 42 are aligned with corresponding recesses 43 of undulating ends 45 and 47 of substantially V-shaped passageways 24 and 28. The openings in the first and second rows 38 and 42 extend from the forwardmost to the rearwardmost portions of passageways 24 and 28. The second row of openings 40 includes three oblong openings which extend from the forwardmost to the rearwardmost portions of passageway 26. The cover plate 8 has a thickness which is substantially less than the depth of recess 30 in top plate 6 for reasons which will be explained below.

The molding plate 10 includes a backing plate 44 and a substantially trapezoidal shaped body member 46. The backing plate 44 includes ends 48 and 50, each of which is formed on a 45° angle. The body member 46 includes an upper surface 52 and a bottom surface 54. The bottom surface 54 is shaped to form the desired configuration of molding. Although a particular shape is shown in the drawings, it will be readily appreciated that the shape may be varied to form different configurations of molding as may be desired. Body member 46 further includes left and right ends 56 and 58 which are formed on a 45° angle. Ends 56 and 58 include chamfered portions 60 disposed adjacent upper surface 52. The ends 48 and 50 of plate 44 include chamfered portions 62 corresponding to portions 60. Left and right ends 56 and 58 lie in the same plane as left and right ends 39 and 41. Thus, chamfered portions 60 and 62 form a substantially V-shaped cavity between plates 6 and 10.

A substantially rectangularly shaped opening 64 extends from the upper surface 52 through the bottom surface 54. A control valve assembly L is associated with the opening 64 for controlling the flow of material through the molding head E.

Figure 8:
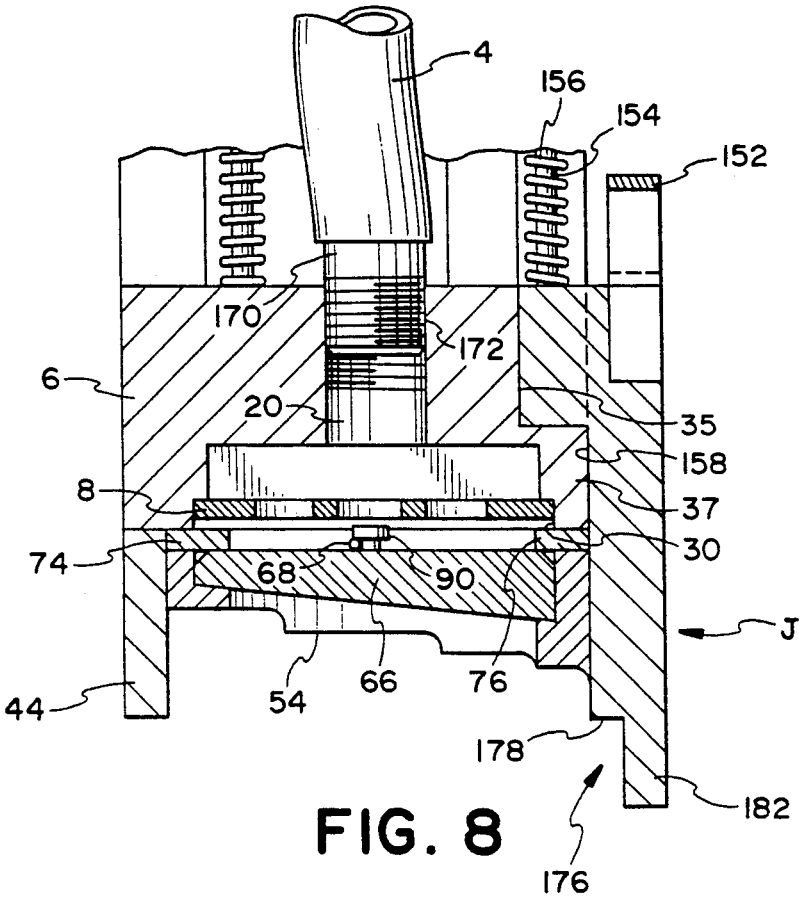
FIG. 8 is a cross-sectional view of FIG. 4 taken along lines A—A.
Figure 3A:
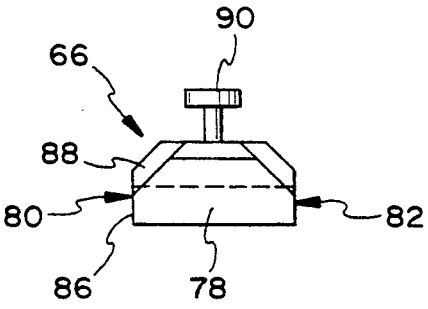
FIG. 3A is a front elevational view of the closure plate.
Figure 3B:
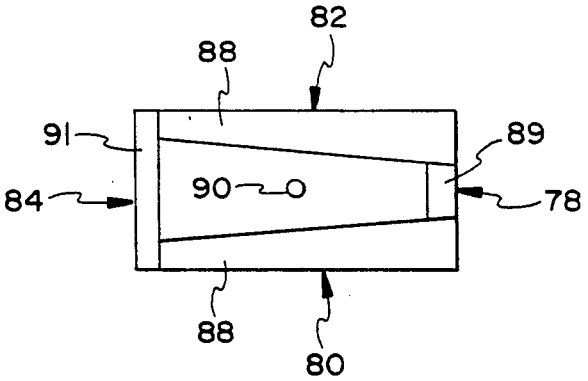
FIG. 3B is a plan view of the closure plate.

Control valve assembly L includes a closure plate 66, a spring 68, an anchoring pin 70, an actuating cable 72, and guide plates 74 and 76. Referring to FIGS. 3A and 3B, the closure plate 66 includes a front face 78, left side 80, right side 82, and rear face 84. The front face 78 has a height substantially greater than rear face 84, and, thus the closure plate 68 is tapered in the direction of backing plate 44. This taper conforms to the variations in depth of the bottom surface 54, as best seen in FIG. 8. The left and right side faces 80 and 82 include a vertical section 86 and an angled or chamfered sections 88 extending between the front and rear faces 78 and 84. Closure plate 66 further includes chamfered sections 89 and 91. A pin 90 extends from the upper surface of closure plate 66.

The spring 68 is connected at one end to anchoring pin 70 and the other end to pin 90. The spring 68 biases the closure plate 66 in the closed position to seal off opening 64. The closure plate 66 has a width greater than that of opening 64. Thus, when the closure plate 66 is in the closed position a portion of the closure plate 66 rests on shelf 92. The shelf 92 and guide plates 74 and 76 prevent the closure plate 66 from moving in the vertical direction. The actuating cable 72 is connected to the pin 90 and passes through openings 36 and 34 in cover plate 8 and top plate 6, respectively. The actuating cable 72 is used to overcome the force of spring 68 to horizontally displace the closure plate 66 to the open position, shown in FIG. 3.

Figure 4:
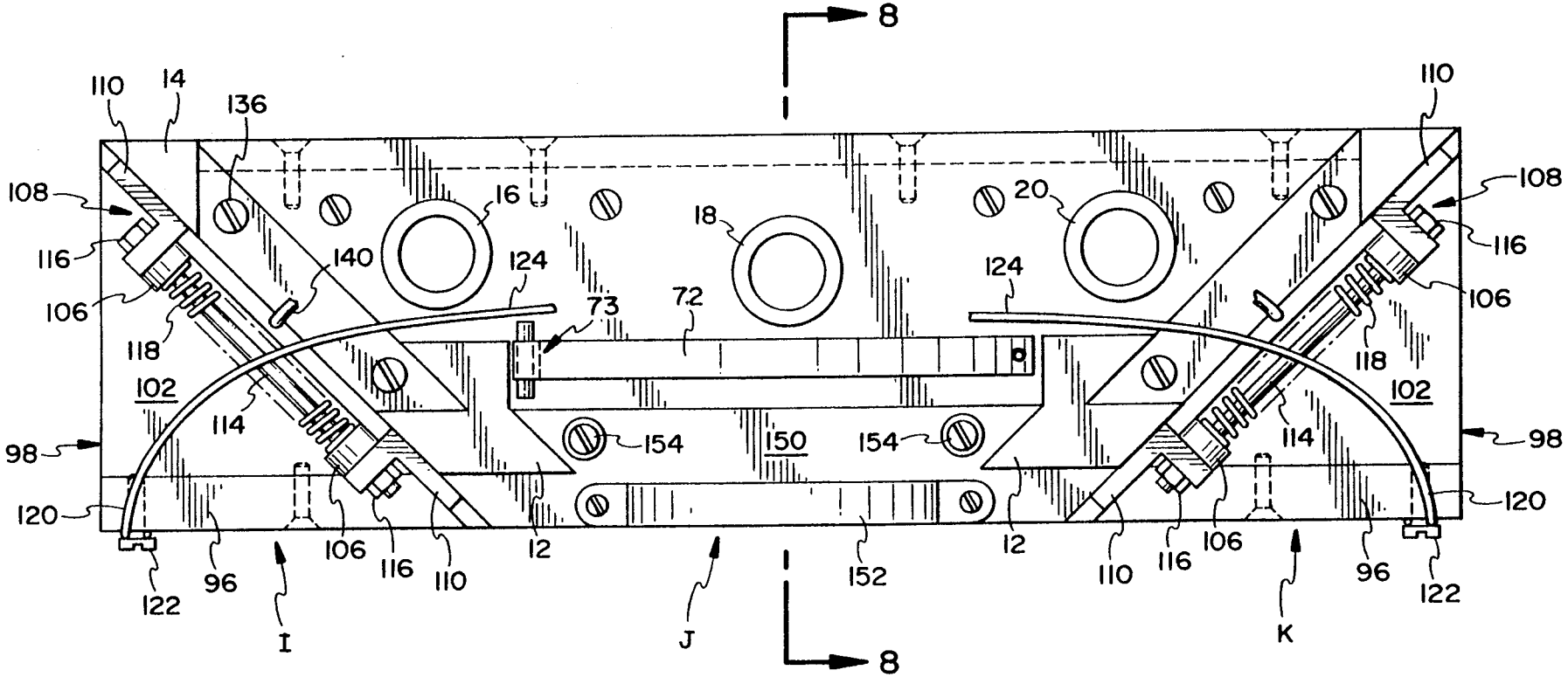
FIG. 4 is a fragmentary plan view of a molding head formed in accordance with the preferred embodiment of the present invention.

As seen in FIGS. 2 and 4, the upper portion of actuating cable 72 is substantially U-shaped and is disposed adjacent the handle G, thereby permitting an individual to engage actuating cable 72 with the hand gripping handle G. End 73 of the actuating cable 72 is secured to top plate 6 by a conventional fastener. As seen in FIG. 8, recess 30 in bottom surface 32 of top plate 6 provides the necessary clearance for anchor pin 70, pin 90 and spring 68. Conventional fasteners such as bolts and the like may be used to secure cover plate 8 and molding plate 10 to top plate 6.

Referring to FIGS. 2, 4, 5 and 7, the independently movable sections I and K will now be described. Since sections I and K are identical, only the details of section I will be described.

Figure 5:
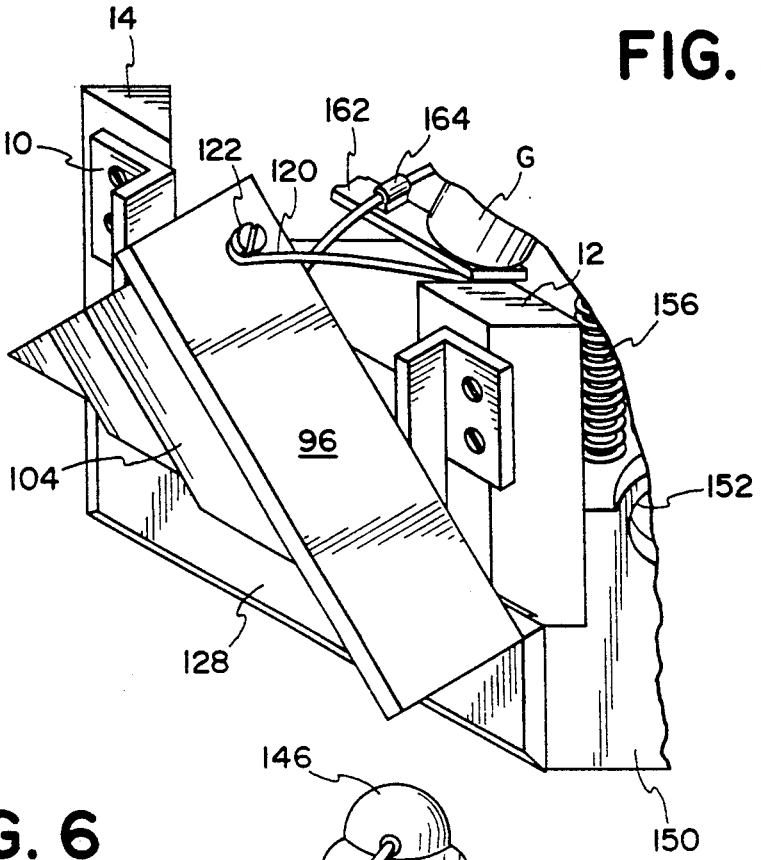
FIG. 5 is a fragmentary perspective view of an end of a molding head formed in accordance with the preferred embodiment of the present invention.

Section I includes a front plate 96 bolted to a corner plate 98. Front plate 96 includes an end 100 formed on a 45° angle to cooperate with the corresponding end of section J. Corner plate 98 includes an upper surface 102 and a bottom surface 104. The upper surface 102 includes a pair of tabs 106 for pivotally mounting independently movable section I to the bracket assembly 108. The bottom surface 104, as seen in FIG. 5, is configured in an identical manner to that of bottom surface 54 of molding plate 10. The right end of corner plate 98 is similarly formed on a 45° angle to be compatible with the 45° angle of the adjacent end of body member H. A substantially triangularly shaped lip 109 extends along the entire distance of the right end of plate 98. Lip 109 is received in the cavity formed by chamfered portions 60 and 62, and aligns section I with central body member H, see FIG. 7.

Bracket assembly 108 includes a pair of L-shaped brackets 110 each having an opening formed in the lower end thereof. A threaded rod 114 extends through the tabs 106 and the openings in brackets 110. Nuts 116 are threaded on each end of rod 114. A spring 118 is disposed on rod 114 and acts to bias independently movable section I in the operating position shown in FIG. 2. The L-shaped brackets 110 are secured to the corresponding front and rear columns 12 and 14 of top plate 6 by bolts or similar fastening mechanisms.

As seen in FIGS. 2 and 4, an actuating cable 120 is secured to bolt 122 at one end and looped end 124 is disposed adjacent handle G. An operator merely pulls actuating cable 120 with the hand gripping handle G to raise the independently movable section I to the position shown in FIG. 5. In this manner, the independently movable section I is pivoted away from the surface the molding strip is being applied to and out of the way of any obstacles formed on or thereabout such as door hinges and the like.

Figure 7:
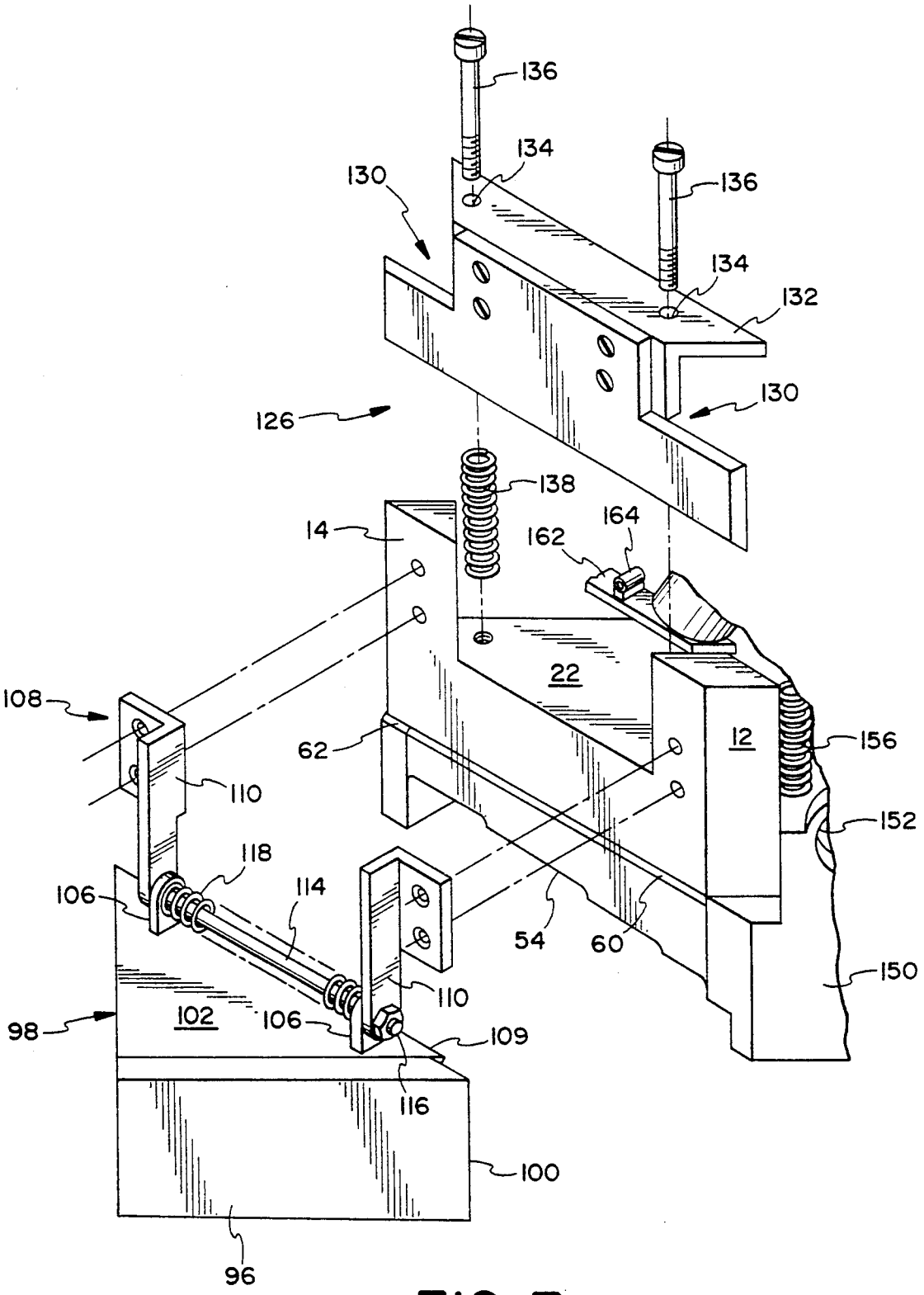
FIG. 7 is an exploded perspective view of one end of a molding head formed in accordance with the preferred embodiment of the present invention.

Referring to FIG. 7, an angle forming assembly 126 is disposed adjacent independently movable section I. The angle forming assembly 126 includes a blade 128 having recessed portions 130 formed therein. The recessed portions 130 receive the adjacent portions of L-shaped brackets 110, as seen in FIG. 2, such that said portions and blade 128 are substantially aligned in the vertical direction. The blade 128 is secured to L-shaped support member 132 by conventional means. The L-shaped support member 132 includes openings 134 formed therein for receiving bolts 136. A pair of springs 138 (only one of which is shown) are disposed on bolts 136 and abut the lip of L-shaped support member 132 to maintain the blade 128 in the storage position shown in FIG. 2.

Referring to FIG. 2, actuating cable 140 includes a first end 142 secured to the upper surface of blade 128. The other end of actuating cable 140 is disposed about the handle G and includes an actuating knob 146 having a recess 148 for receiving the thumb of an operator. To lower the blade 128 to an operating position, an operator must first raise the independently movable section I to the position shown in FIG. 5 by pulling on cable 120 and, subsequently depress actuating knob 146.

Referring to FIGS. 2, 4 and 8, independently movable section J will now be described. Section J includes a jump plate 150, a handle 152, a pair of bolts 154, and a pair of springs 156. The jump plate 150 has a recess 158 formed therein corresponding to step 37 of top plate 6, as seen in FIG. 8. Bolts 156 are embedded in molding plate 10, but do not extend through the bottom surface 54, to secure the movable section J to the central body member H. The springs 156 act to bias the jump plate 150 downwardly in the operating position shown in FIG. 2. The jump plate 150 can be moved upwardly into a storage position by merely pulling on handle 152 to overcome the force of springs 156. Once the jump plate 150 is in the storage position (not shown), that portion of the molding head E adjacent the jump plate 150 can traverse an object such as a door hinge which may be located on or about the surface the molding is being applied to.

The handle 152 and actuating cable 72 are aligned with handle G in a horizontal direction. Thus, an operator can grip handle G, actuating cable 72 and handle 152 at the same time. The ends of the jump plate 150 are formed at 45° angles to conform to the angled ends 100 of corresponding plates 96.

Referring to FIG. 2, the handle G is secured at opposite ends to horizontally extending plates 162 which in turn are secured to corresponding front and rear columns 12 and 14, respectively. Eyelets 164 are formed on plates 162 to receive cables 140. Similar eyelets may be formed on the underside of plates 162 to receive actuating cables 120. The handle G is disposed substantially directly above actuating cable 72.

Referring to FIG. 8, a hollow connector 170, having a threaded portion 172 joins supply lines 4 with corresponding orifices 16, 18 and 20. It will be readily appreciated that connector 170 may be omitted by threading supply lines 4 directly into orifices 16, 18 and 20. Extension arm F, when used, may be pivotally connected to molding head E by a conventional ball and socket joint.

Figure 6:
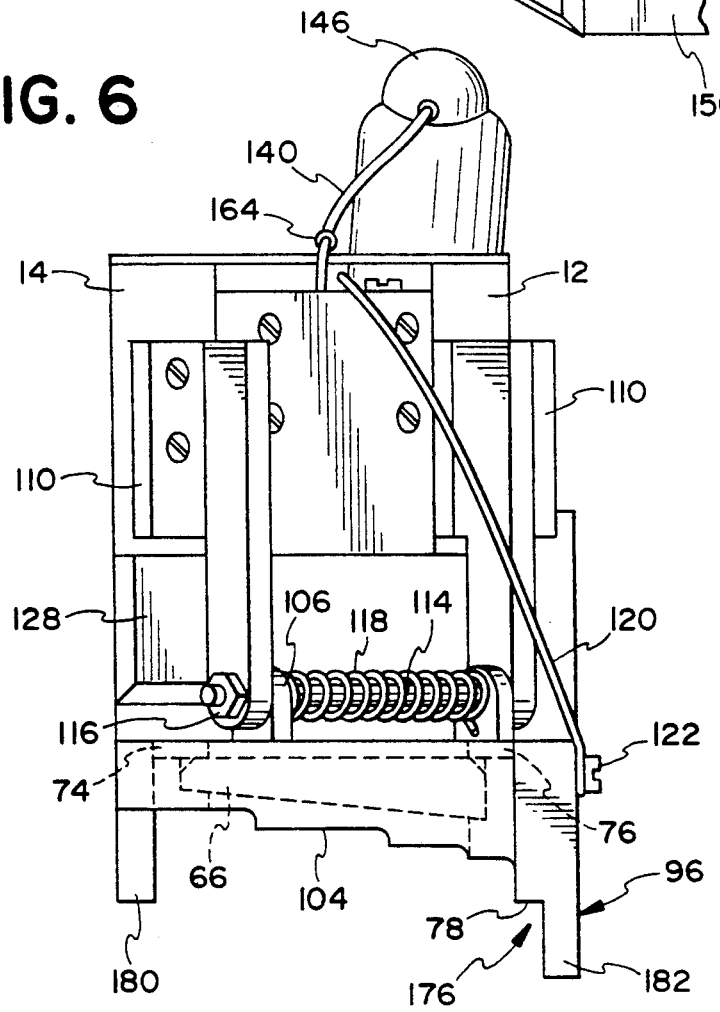
FIG. 6 is a side elevational view of a molding head formed in accordance with the preferred embodiment of the present invention.

As seen in FIGS. 6 and 8, plates 96 of sections I and K and jump plate 150 of section J each include a step 176 formed therein. The step 176 includes a horizontal surface 178 which extends in the same plane as horizontal surface 180 of plate 44. The step 176 further includes a vertically extending lip 182. While the lower edges of plates 96, 150 and 44 are shown as being square, it will be readily appreciated that said edges may be rounded to facilitate movement of the head E along a wall surface.

METHOD OF OPERATION

The manner of operation of the molding installation system A will now be explained. Specifically, the steps for forming molding about a doorway will be recited hereinafter. However, it will be readily appreciated that the present invention is not limited to the application of molding about a doorway. Rather, the present invention may be used to form molding in numerous other locations.

Air, under pressure, is passed from pressure source B to storage tub C via pressure line 2. The pressurized air forces the molding material from the storage tub C through the supply lines 4 to molding head E. For most doorways, the extension arm F is not needed, rather the operator grips the molding head E by handle G. Initially, the valve 66 is biased in the closed position by spring 68 preventing the material from flowing through the molding head E. The step 176 is used to properly align the molding head E on the wall surface. More specifically, the step 176 is positioned at the base of the doorway such that lip 182 abuts the doorjamb while the surface 178 rests on the surrounding wall The operator subsequently pulls upwardly on the handle 72 to move valve 66 to the position shown in FIG. 3, thereby permitting the material to flow through opening 64. The operator must wait a sufficient time to permit the material to completely fill the bottom cavity of the molding head E. Once the bottom cavity is filled, the molding head E is moved upwardly along the doorway to form the left vertically extending strip of molding.

Upon encountering the first door hinge, section K is raised by pulling on cable 120 and the molding head E is moved such that Section J abuts the hinge. At this point, section J is raised by pulling on handle 152 and the molding head E is moved such that section I abuts the hinge. Section K is lowered by releasing the corresponding cable 120 and section I is raised by pulling on the corresponding cable 120. Sections J and I are lowered as the molding head E passes by the door hinge. Any other door hinges which are encountered are traversed in a similar manner.

A 45° angle is formed in the uppermost portion of the left vertical strip of molding adjacent the upper left hand corner of the doorway in the following manner. Section K is raised by pulling on cable 120 and blade 128 is lowered by depressing knob 146. The molding head E is held in a stationary position to form an angled end in the left vertical strip of molding. Thereafter, the operator releases cable 72 to close opening 64 to prohibit the flow of material through the head E. The molding head E is positioned adjacent the raised horizontal portion of the doorway. Section I is raised by pulling cable 120 and blade 128 is maintained in the raised or storage position. The left edge of central body member H is positioned in abutting contact with the angled end just formed in the left vertical strip of molding. The cable 72 is pulled upwardly to permit the material to flow through the molding head E. The head E is maintained in that position for several seconds to permit formation of a corresponding angled end in the horizontally extending strip of molding formed above the doorway. Subsequently, the head E is moved to the right and section I is lowered once the head has moved a sufficient distance to prevent deformation of the corner section of molding just formed.

An angled end is formed in the right end of the horizontal strip by raising section K and lowering the corresponding blade 128. To form the final vertical strip of molding, the molding head E is positioned adjacent the right angled corner of the horizontal strip of molding with lip 182 abutting the doorjamb. Section I is raised and blade 128 is maintained in the raised or storage position. The molding head E is positioned such that the left edge of central body member is in abutting contact with the right angled corner of the horizontal strip of molding. Subsequently, the molding head E is moved downwardly. Section I is lowered once the molding head E has moved away from the right corner section of molding a sufficient distance to prevent deformation thereof.

In the above manner, molding readily and easily can be formed about a doorway. It will be readily appreciated that the sequence of forming the strips of molding may be varied as desired. The first, second and third rows of openings 38, 40, and 42 provide the molding with a wood-type finish. The angled sections 88, 89 and 91 of the closure plate 66 facilitate the movement thereof to open and close opening 64.

While this invention has been described as having a preferred design, it is understood that it is capable of further modifications, uses and/or adaptions of the invention following in general the principle of the invention including such departures from the present disclosure as come within the known or customary practice in the art to which the invention pertains, and as may be applied to the central features set forth and fall.

I claim:

1. An apparatus for applying a flowable material to a surface for forming at least one strip of molding thereto, said apparatus including:

a) a body member having top, bottom, front and rear surfaces;

b) an inlet operably associated with said body member for receiving a flowable material from a supply source;

c) an outlet means operably associated with said body member for dispensing flowable material from said body member;

d) at least one passageway extending between said inlet and said outlet means;

e) said body member further including shaping means for shaping the flowable material to form at least one strip of molding on a surface by moving said shaping means relative to the surface;

f) said shaping means having front and rear walls and a shaping surface extending there between, said front wall, rear wall and said shaping surface forming a molding cavity having left and right open end portions;

g) a closure member operably associated with one of said left and right open end portions for closing said one of said left and right open end portions for forming an end of said at least one strip of molding.

2. An apparatus as in claim 1, further including:

a) said outlet means includes a plurality of openings, one of said plurality of openings having a shape different from one other of said plurality of openings.

3. An apparatus as in claim 1, further including:

a) at least first and second sections operably associated with said body member, said first section is movable relative to said second section thereby permitting said body member to transverse objects protruding from the surface.

4. An apparatus as in claim 3, further including:

a) a third section operably associated with said body member, said first, second an third sections are movable away from the surface thereby permitting the body member to readily transverse objects protruding from the surface.

5. An apparatus as in claim 4, wherein:

a) said first and third sections are adapted to pivot upwardly about a fixed point;

b) said second section is adapted to move parallel to a vertical axis of said body member; and c) said second section is positioned intermediate said first and third sections.

6. An apparatus for applying a flowable material to a surface for forming at least one strip of molding thereon, said apparatus including:

a) a body member having top, bottom, front and rear surface;

b) an inlet operably associated with said body member for receiving flowable material from a supply source;

c) an outlet operably associated with said body member for dispensing flowable material from said body member;

d) at least one passageway extending between said inlet and said outlet;

e) said body member further including a shaping means for shaping the flowable material to form at least one strip of molding on the surface by moving said shaping means relative to the surface;

f) first angle forming means for forming an angle in a first end of the strip of molding, said angle forming means being operably associated with said body member.

7. An apparatus as in claim 6, wherein:

a) second angle forming means for forming an angle in a second end of the strip of molding, said second angle forming means is operably associated with said body member and spaced from said first angle forming means.

8. An apparatus as in claim 4, further including a) a handle operably connected to said body member;

b) first activating means for pivoting said first section between an operating position and a storage position;

c) second activating means for pivoting said third section between an operating position and a storage position, d) third activating means for linearly displacing said second section between an operating position and a storage position; and said first, second and third activating means include an activating member disposed adjacent said handle thereby permitting an operator to engage said first, second, and third activating means with a hand gripping said handle.

9. An apparatus as in claim 7, further including:

a) first engaging means for engaging said first angle forming means to form an angle in a first end of the strip of molding;

b) second engaging means for engaging said second angle forming means to form an angle in a second end of the strip of molding; and c) said first and second engaging means are disposed about said handle.

10. An apparatus as in claim 2, wherein:

a) said outlet means includes at least first and second rows of openings;

b) said first and second rows of openings each include at least two aligned openings; and c) said at least two openings of said first row of openings have a different configuration than said at least two openings of said second row of openings.

11. An apparatus as in claim 10, wherein:

a) said outlet means includes a third row of openings having at least two aligned openings;

b) said at least two openings of said third row of openings have an identical configuration to said at least two openings of said first row of openings; and c) said second row of openings is positioned intermediate said first and third row of openings.

12. An apparatus as in claim 1, further including:

a) a handle operably connected to said body member;

b) valve means for opening and closing said outlet means; and c) control mean for moving said valve means between a first position where said outlet means is closed and a second position where said outlet means is open, said control means is positioned adjacent said handle such that an operator can grasp said control means with a hand gripping said handle.

13. An apparatus as in claim 12, wherein:

a) said valve means includes a closure pate positioned intermediate said top and bottom surfaces of said body member;

b) said closure plate includes upper, lower, front, rear, left side and right side surfaces, said front surface has a thickness greater than said rear surface and said left and right sides each include a tapered portion; and c) spring means for biasing said closure plate in said first position.

14. An apparatus as in claim 1, wherein:

a) said shaping means includes a first side wall and a second side wall and a molding face extending between said first and second side walls.

15. An apparatus as in claim 14, wherein:

a) said first side wall has a height greater than said second side wall;

b) said first side wall includes a bottom surface, said bottom surface of said first side wall has a step formed therein.

16. An apparatus for applying a flowable material to a surface for forming at least one strip of molding thereon, said apparatus including:

a) a body member having top, bottom, front and rear surfaces;

b) a plurality of inlets operably associated with said body member for receiving flowable material from a supply source;

c) an outlet means operably associated with said body member for dispensing flowable material from said body member;

d) at least one passageway extending between said plurality of inlets and said outlet means;

e) said body member further including shaping means for shaping the flowable material to form at least one strip of molding on the surface by moving said shaping means relative to the surface; and, f) at least first and second sections operably associated with said body member, said first section is movable relative to said second section thereby permitting said body member to traverse objects protruding from the surface.

17. An apparatus as in claim 16, further including:

a) said outlet means includes a plurality of openings, one of said plurality of openings having a shape different from one other of said plurality of openings.

18. An apparatus as in claim 16, further including:

a) a third section operably associated with said body member, said first, second and third sections are movable away from the surface thereby permitting the body member to readily traverse objects protruding from the surface.

19. An apparatus as in claim 18, wherein:

a) said first and third sections are adapted to pivot upwardly about a fixed point;

b) said second section is adapted to move parallel to a vertical axis of said body member; and c) said second section is positioned intermediate said first and third sections.

20. An apparatus as in claim 16, further including:

a) first angle forming means for forming an angle in a first end of the strip of molding, said first angle forming means being operably associated with said body member.

21. An apparatus as in claim 20, further including:

a) second angle forming means for forming an angle in a second end of the strip of molding, said second angle forming means is operably associated with said body member and spaced from said first angle forming means.

* * * * *